US009022678B2

(12) United States Patent
Mendicino

(10) Patent No.: US 9,022,678 B2
(45) Date of Patent: May 5, 2015

(54) TOOL WITH VARIABLE FUNCTIONS FOR CASINO OPERATIONS

(71) Applicant: Patrick Mendicino, Sewickley, PA (US)

(72) Inventor: Patrick Mendicino, Sewickley, PA (US)

( * ) Notice: Subject to any disclaimer, the term of this patent is extended or adjusted under 35 U.S.C. 154(b) by 0 days.

(21) Appl. No.: 13/900,846

(22) Filed: May 23, 2013

(65) Prior Publication Data

US 2013/0315649 A1 Nov. 28, 2013

Related U.S. Application Data

(60) Provisional application No. 61/650,523, filed on May 23, 2012.

(51) Int. Cl.

| | |
|---|---|
| ***A47L 13/26*** | (2006.01) |
| ***B43K 29/18*** | (2006.01) |
| ***B43K 27/02*** | (2006.01) |
| ***A63F 1/06*** | (2006.01) |
| ***A63F 11/00*** | (2006.01) |
| ***A63F 3/00*** | (2006.01) |
| *A63F 9/00* | (2006.01) |
| *A63F 9/06* | (2006.01) |

(52) U.S. Cl.

CPC ..... *B43K 29/18* (2013.01); *B43K 27/02* (2013.01); *A63F 1/06* (2013.01); *A63F 2009/0018* (2013.01); *A63F 2009/0055* (2013.01); *A63F 2009/0665* (2013.01); *A63F 11/0025* (2013.01); *A63F 2011/0041* (2013.01); *A63F 3/00157* (2013.01); *A63F 3/00895* (2013.01)

(58) Field of Classification Search

CPC .... B43K 27/00; B43K 27/003; B43K 27/006; B43K 27/02; B43K 27/04; B43K 27/08; B43K 27/12; B43K 29/00; B43K 29/06; B43K 29/18; B26B 11/00

USPC ..... 401/29–35, 37; 7/158, 160

See application file for complete search history.

(56) References Cited

U.S. PATENT DOCUMENTS

| | | | | |
|---|---|---|---|---|
| 2,749,953 | A * | 6/1956 | Rundle | 81/490 |
| 3,706,106 | A * | 12/1972 | Leopoldi | 7/158 |
| 3,750,729 | A * | 8/1973 | Lemieux | 81/439 |
| 4,635,309 | A * | 1/1987 | Larsen | 7/158 |
| 4,968,167 | A * | 11/1990 | Kageyama | 401/31 |
| 7,774,941 | B2 * | 8/2010 | Johnson et al. | 30/162 |
| 8,191,192 | B1 * | 6/2012 | Barker | 7/160 |

* cited by examiner

*Primary Examiner* — David Walczak

(74) *Attorney, Agent, or Firm* — David G. Oberdick

(57) ABSTRACT

A hand held variable tool for use in casino operations that has optional functions of, at least, (i) a small tip writing instrument such as a pencil or pen, (ii) a large tip writing instrument such as a marker, and (iii) a cutting or scoring tool, such as a sharp-tipped needle or nail to aid in "scoring" and opening the cellophane around a new deck of playing cards. The tool can be clipped to the badge of a user for ease of transport while not in use.

8 Claims, 2 Drawing Sheets

FIG. 1
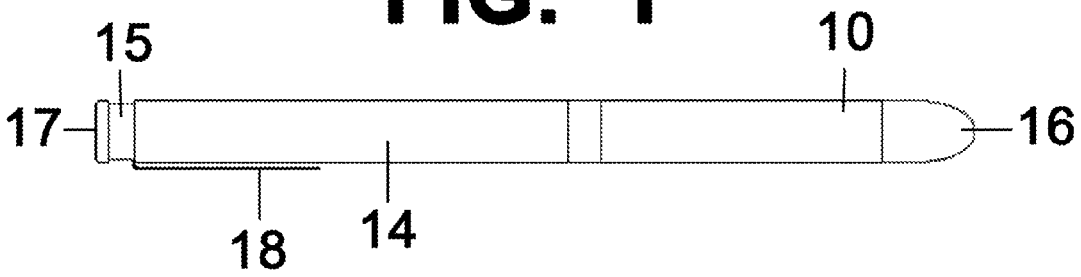
FIG. 2
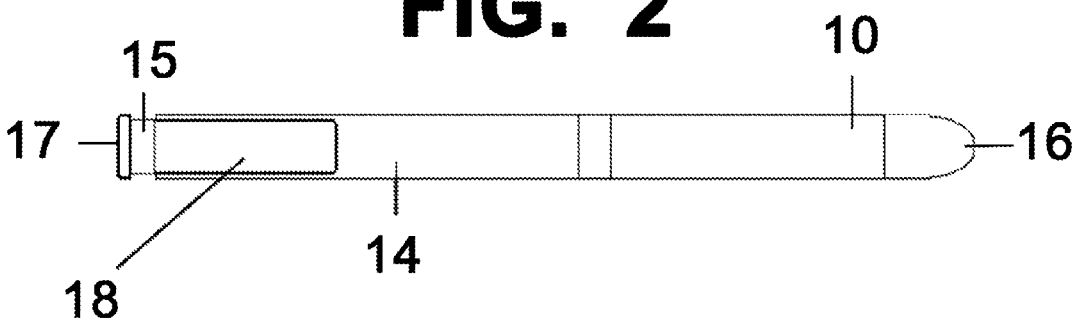
FIG. 3a
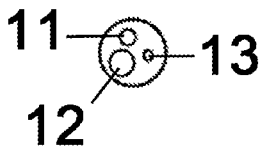
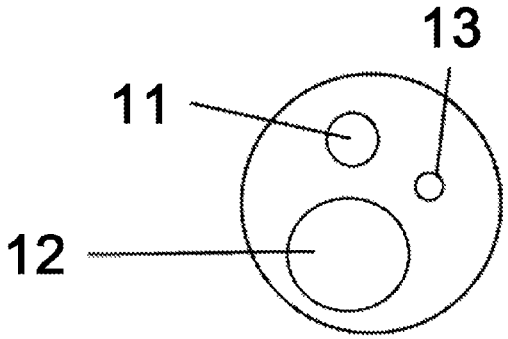
FIG. 3b

TOOL WITH VARIABLE FUNCTIONS FOR CASINO OPERATIONS

CROSS REFERENCE TO RELATED APPLICATIONS

The present invention claims benefit of U.S. Provisional Application Ser. No. 61/650,523, entitled "Tool with Variable Functions for Casino Operations" filed on May 23, 2012, which is incorporated herein by reference.

FIELD OF THE INVENTION

The invention pertains to the a tool with variable functions for casino operations. More particularly, the invention pertains to a hand held instrument that has optional functions of a small tip writing instrument such as a pencil or pen, a large tip writing instrument such as a marker and a cutting or scoring tool, such as sharp-tipped needle or nail to aid in "scoring" and opening the cellophane around a new deck of playing cards.

BACKGROUND OF THE INVENTION

"Pit" bosses or supervisors within the casino industry have a need for a multi-function hand-held tool that includes a writing instrument as well as a sharp-tipped needle, nail or other similar object to provide help in scoring and opening new playing card packs (which are wrapped in cellophane). In particular, it is beneficial for a pit boss or supervisor to have a pen/pencil and a felt-tipped marker. The latter is used to mark decks that are retired and/or damaged and therefore are taken out of circulation and use.

A casino pit boss or supervisor can further benefit from a sharp-tipped tool that can aid in opening the cellophane around new playing card decks. Knifes and other larger objects with sharp edges can be unwieldy and present safety issues.

SUMMARY OF INVENTION

The present invention addresses the needs of a casino pit boss or supervisor for a multi-function tool. Specifically, the present invention provides a hand held instrument that has optional functions of, at least, (i) a small tip writing instrument such as a pencil or pen, (ii) a large tip writing instrument such as a marker, and (iii) a cutting or scoring tool, such as a sharp-tipped needle or nail to aid in "scoring" and opening the cellophane around multideck card packs. The tool can be clipped behind the ID badge or credentials worn on the shirt of a user for ease of transport while not in use.

BRIEF DESCRIPTION OF THE DRAWINGS

FIG. 1 shows a side view of the variable function casino tool of one embodiment of the present invention.

FIG. 2 shows a front view of the variable function casino tool of one embodiment of the present invention.

FIG. 3*a* shows a cross-sectional view of the variable function casino tool of one embodiment of the present invention.

FIG. 3*b* shows an enlarged cross-sectional view of the variable function casino tool of one embodiment of the present invention

DESCRIPTION OF PREFERRED EMBODIMENTS

Figure 4:
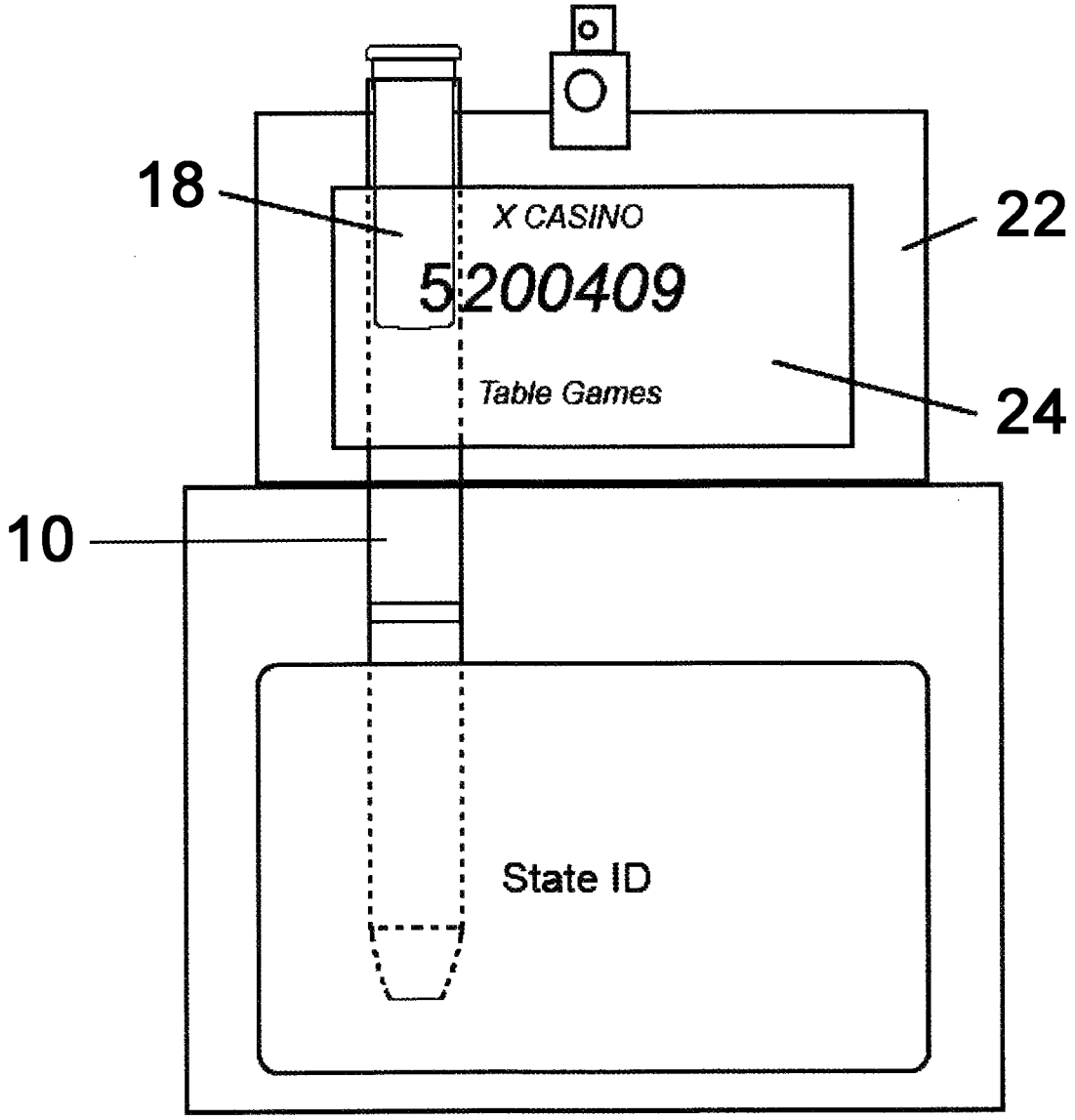
FIG. 4 shows the placement of the casino tool of the present invention inside the identification holders of a casino pit boss or supervisor.

Reference will now be made in detail to the presently preferred embodiments of the invention, examples of which are illustrated in the accompanying drawings, wherein like reference numbers refer to like elements throughout.

Referring to FIGS. 1-4, the present invention is a multi-function hand-held tool 10 that is intended for use be a pit boss or supervisor. In a preferred embodiment, the tool 10 contains at least three instruments positioned alongside each other and inside container 14 that can be interchangeably used, i.e.,—(i) a small tip writing instrument; preferably, a small tip writing instrument 11, such as a pen, pencil, (ii) a large tip writing instrument 12, such as a marker, and (iii) a scoring instrument 13, such as a sharp-tipped needle or nail. The writing instruments 11 and 12 are preferably black, although other colors can be used. The scoring instrument 13 is preferably comprised of a hard material and has a sharp tip. Other instruments can be added optionally.

Small tip writing instrument 11 can be a pen or pencil or other similar writing instrument that allows a user to write notes, including a crayon or other similar writing device. Large tip writing instrument 12 is preferably a marker that uses an ink that is permanent or otherwise not easily removed. A broad tipped pen can also be used. A single marker is used in a casino to mark used card decks (the marker is used to draw a broad line across the edge or edges of a card deck that is going to be retired and taken out of circulation. Preferably, writing instruments 11 and 12 use a dark colored graphite, ink or pigment. Other colors can be used, however. In an alternative embodiment of the invention, either instrument 11 or 12 can be a counterfeit detector pen that uses an iodine solution, or other similar solution, to create a discoloration or stain when a counterfeit bill is tested.

Scoring instrument 13 is used to score or cut the cellophane around new multideck packs of cards, or the paper seal on individual decks of cards. Any sharp tipped instrument, such as a needle or nail, capable of assisting in this operation can be used. A narrow blade may also be used for scoring instrument 13.

The instruments are positioned side-by-side inside a hollow pen-like or tubular container 14, as shown in FIGS. 1 and 2, and the container 14 contains a mechanism 15—preferably at the bottom end of the container 14—that allows a user to activate each instrument for use. By way of example, but not limitation, each instrument can be spring-mounted within the container 14 and associated with a push mechanism, known to those skilled in the art, that allows the user to push each instrument upward through the top 16 of the tool container 14, where it locks into use and later can be disengaged. Each instrument can have its own separate activation mechanism 15—or a common mechanism 15 can be used to activate each instrument from inside the container. More specifically, a single push mechanism 15 at the bottom 17 of the tool container 14 can, upon depression (i.e., a "click" of the push mechanism), activate each of the instruments in sequence—with one instrument being activated for use as the prior instrument withdraws into the container. Alternatively, each instrument can be individually selected for activation. Other individual or combined activation mechanisms 15 can also be used.

The dimensions of the tool 10 of the present invention can vary, as can the component materials of the container and the instruments. In one preferred embodiment, tool 10 is about 14 centimeters in length, although other lengths can be used As further shown in FIG. 4, tool 10 can have a clip 18 that allows tool 10 to be clipped behind a badge/identification holder 22. FIG. 4 shows use of tool 10 with the identification holder 22 of a pit boss or supervisor. In a preferred embodiment, the width of clip 18 is consistent with the diameter of container 14. A wide clip is beneficial in the casino environment because it allows a user to use two fingers only in removing the tool from the badge. Other widths can be used, though. Also in a preferred embodiment, clip 18 is clear or transparent/translucent so that it does not obstruct view of the information on badge 22 (as shown in FIG. 4). Badge 22, in casino operations, will typically include casino identification information 24, as well as state identification information The invention is described above in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated apparatus, and such further applications of the principles of the invention illustrated herein, as would normally occur to persons skilled in the art to which the invention relates.

What is claimed is:

1. A hand held variable tool for use in casino operations consisting of:

a hollow, tubular container, a small tip writing instrument and a large tip writing instrument positioned longitudinally inside the container, wherein the small tip writing instrument or the large tip writing instrument is a counterfeit detector pen;

a scoring instrument positioned longitudinally inside the container, wherein the scoring instrument is sharp tipped and selected from the group consisting of a needle or nail; and an activation mechanism that activates each instrument longitudinally from inside the container.

2. The tool as recited in claim 1, wherein the tool further consists of a clip that allows the tool to be clipped to a user.

3. The tool as recited in claim 2, wherein the clip is a transparent or translucent clip.

4. The tool as recited in claim 1, wherein the small tip writing instrument is selected from the group consisting of a pen, pencil, and crayon.

5. The tool as recited in claim 1, wherein the large tip writing instrument is selected from the group consisting of a marker and large-tipped pen.

6. The tool as recited in claim 1, wherein the large tip writing instrument uses a permanent ink or pigment.

7. The tool as recited in claim 1, wherein the scoring instrument is capable for use in opening the cellophane around a new deck or decks of playing cards.

8. The tool as recited in claim 1, wherein the activation mechanism is located at the bottom of the container and pushes a selected instrument upward from the top of the container.

* * * * *